United States Patent [19]

Jones et al.

[11] Patent Number: 4,756,061

[45] Date of Patent: Jul. 12, 1988

[54] END TERMINATING MEANS FOR ZIP FASTENERS

[76] Inventors: James T. Jones; Dennis N. H. Jones, both of 24B Weatherhill Road, Smallfield, Horley, Surrey, United Kingdom

[21] Appl. No.: 53,115

[22] Filed: May 21, 1987

[51] Int. Cl.[4] ..... A44B 19/36

[52] U.S. Cl. ..... 24/433; 24/435

[58] Field of Search ..... 24/433, 432, 434, 435, 24/429, 437, 236, 389, 384, 381

[56] References Cited

U.S. PATENT DOCUMENTS

| | | | |
|---|---|---|---|
| 2,537,939 | 1/1951 | Murphy | 24/433 |
| 3,752,718 | 8/1973 | Potin | 24/434 |
| 4,112,553 | 9/1978 | Weitzner . | |

FOREIGN PATENT DOCUMENTS

| | | | |
|---|---|---|---|
| 143854 | 9/1980 | German Democratic Rep. . | |
| 626241 | 11/1981 | Switzerland . | |
| 0479543 | 2/1938 | United Kingdom | 24/435 |
| 1033193 | 6/1966 | United Kingdom | 24/433 |
| 2090326 | 7/1982 | United Kingdom . | |
| 2131482 | 6/1984 | United Kingdom . | |
| 2159875 | 12/1985 | United Kingdom . | |
| 2180591 | 4/1987 | United Kingdom . | |

*Primary Examiner*—Victor N. Sakran

*Attorney, Agent, or Firm*—Andrus, Sceales, Starke & Sawall

[57] ABSTRACT

End terminating means (30,32) for a zip fastener (10), which comprises two strips of material (12,14) adapted to be releasably secured together, is in the form of a receptacle (FIG. 2*a*) having an open end through which adjacent ends of the strips are inserted. The receptacle has a dove-tailed lid (42) pivoted above an opening in the receptacle and incorporating barbs (48,50) adapted to hook into the strips (12,14) to retain them in the receptacle. The lid engages the edges of the opening to lock it in the closed position.

8 Claims, 1 Drawing Sheet

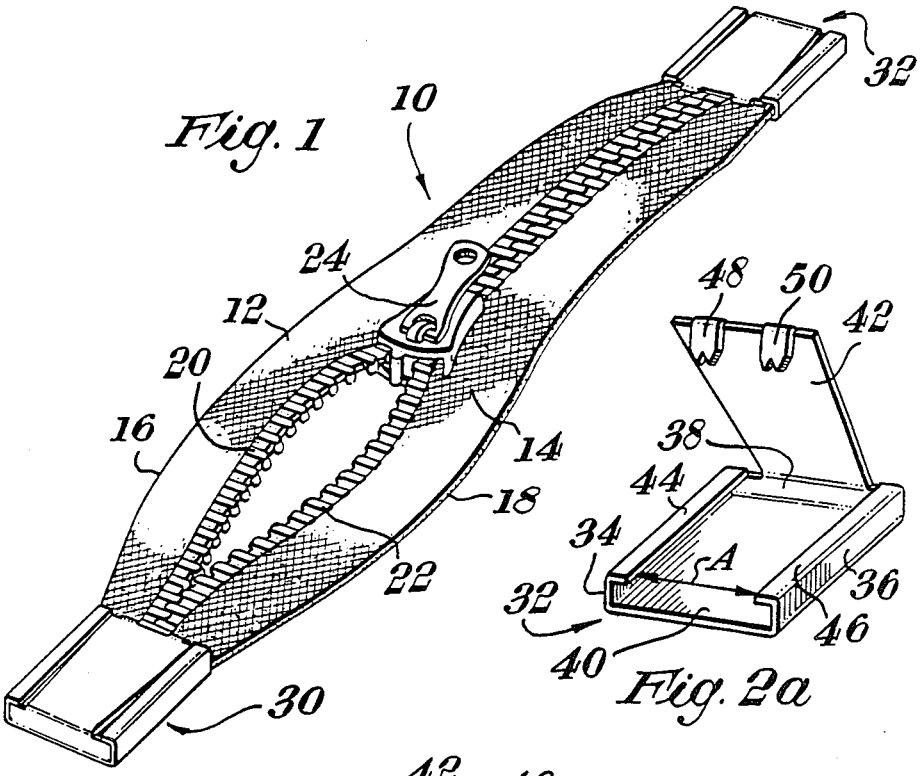
Fig. 1
Fig. 2a
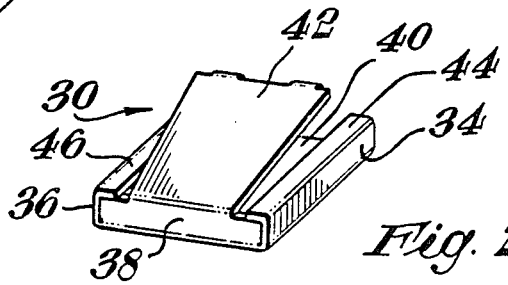
Fig. 2b
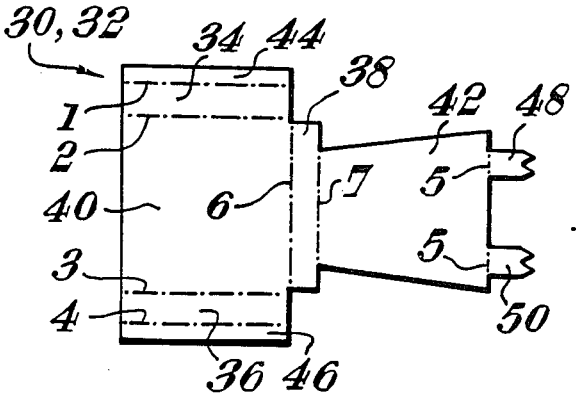
Fig. 3

END TERMINATING MEANS FOR ZIP FASTENERS

This invention relates to sliding clasp fasteners, referred to herein as zip fasteners, and means for terminating one or both ends thereof.

Zip fasteners comprise two strips of material each provided with a row of teeth, those on one strip adapted to engage and interlock with the teeth on the other strip so as secure the two strips together and hence those elements to which the two strips are attached.

Those elements may comprise parts of any article it is desired to releasably secure together, from parts of clothing to tents or the openings of bags and cases etc.

It is necessary to arrange, however, that the sliding clasp or runner which is drawn up and down the zip to join and disjoin the zip cannot come adrift from the zip.

In clothes, where it is usual that the parts connected by the zip must be completely separable, the teeth on each strip may be terminated at each end by a block over which the runner cannot pass except at the bottom of one strip in the opening direction for when the parts are to be completely separated.

In some articles it is not necessary for the parts to be entirely separable such as for instance in suitcases, brief cases or document wallets where the zip defines an opening into the article. At the ends of the zip the parts are usually permanently joined together.

Sometimes however, even in these instances it is sometimes arranged that one end (the "open" end) of the zip is unattached from the parts so that it forms a tab which can be gripped to provide a reaction against the pull on the zip when the runner is drawn up the zip, and thereby closing it. It is possible, although less frequently done, that the "closed" end of the zip may also be arranged to have a tab which can be gripped when opening the zip.

In either event however the zip must be permanently joined together at the ends forming the tab and in such a way as to prevent the runner from being drawn over the tab and off the zip.

In suitcases, briefcases, attache cases etc. this tab has hitherto been comprised of a leather or plastics fob sewn on to the ends of the zip. However, such a process is time consuming and not simple to effect.

Consequently it is an object of the present invention to provide means to terminate the ends of a zip which does not suffer these disadvantages.

In accordance with the invention there is provided means for terminating an end of a zip fastener comprising two strips of material each provided with teeth, those on one strip adapted to engage and interlock with the teeth on the other so as to secure the strips together, said means comprising a flattened receptacle having an open end for receiving the adjacent ends of the strips and securing means within the receptacle to retain the strips therein. A preferred receptacle comprises a flattened box of rigid material having an open end and a lid pivoted at the other end and including locking means to lock the lid in a closed position about the ends of the two strips, securing means being provided to retain the strips in the box.

The invention also extends to a zip fastener provided with such means terminating an end thereof.

Preferably the box comprises a channel in section, the lid being arranged to close the channel and having a breadth slightly greater than the opening of the channel, said locking means comprising the interference between said lid and the opening of the channel when the lid is engaged therewith. The lid may be dove-tailed in shape.

Preferably the securing means comprises barbs on the lid adapted to hook into the material of the strips on either side of the engaged teeth adjacent the end of the zip when it is positioned within the confines of the box.

The box may be of plastics material but preferably is shaped from metal punched from a sheet. In this case the barbs ideally comprise projections on the edge of the lid.

The invention is further described hereinafter with reference to the accompanying drawings in which:

FIG. 1 is a perspective view of a zip fastener having means to terminate the ends thereof in accordance with the invention;

FIGS. 2*a* and *b* are two perspective views of the means shown in FIG. 1; and FIG. 3 is a plan view of a blank from which the means of FIG. 1 is constructed.

In the drawings a zip fastener 10 comprises two strips 12, 14 of material securable along their edges 16, 18 by sewing for instance to parts (not shown) which it is desired to render releasably attachable together. The strips 12, 14 have along their other edges teeth 20, 22 which are guided into engagment with one another by a runner 24. All these features are well known in the art and require no further description here.

The ends of the zip 10 are provided with terminating means 30, 32 in accordance with the invention. These hold the ends of the strips 12, 14 together, particularly at the end 32 where means is required to ensure that the ends of the zip do not come apart. This end is also that end which, in such articles as brief and attaché cases, is often left unattached to the sides of the case and therefore requires means not only to keep the zip together but also to prevent the runner 24 from being drawn entirely off the end of the zip when it is opened. There is nothing to suggest that a similar arrangement cannot be made at the end 30 (as is shown in FIG. 1 of course) although at this end there is no requirement to keep the strips 12, 14, and hence their teeth 20, 22, together.

In either case, the reason the end is left unattached to the case is so that it provides a grip to provide a reaction against the movement of the runner away from the end in question. Clearly this is somthing which needs to be aesthetically pleasing in attache cases and the like.

Thus each terminating means 30, 32 is a flattened box-like receptacle comprising side-walls 34, 36, end wall 38, base wall 40, lid 42 and flanges 44, 46. The lid 42 has barbs 48, 50. The structure may be fashioned from a sheet of metal punched to the shape shown in FIG. 3 and bent along the dotted lines indicated in FIG. 3 and preferably in the order shown from 1 to 7. All bends are preferably right-angles except bend 5 forming the barbs 48, 50 which is arranged to form an angle of about 20° with the lid 42 to effectively grip the material of the strips 12, 14, and bend 7 which is left at an angle about 10° short of a right angle (FIGS. 2*a* and *b*).

It is evident that the lid 42 is dovetailed in shape and has a maximum breadth greater than the separation A between the flanges 44, 46 which together with the sides 34, 36 and base 40 constitute a channel in section.

Thus the ends of the two strips 12, 14 are placed in the channel section with their ends abutting the end wall 38. The lid 42 is then closed while the side-walls 34, 36 are sprung apart slightly with a suitable tool, without permanently distorting the material of the walls, until the dimension A is sufficient to receive the lid between and under the flanges 44, 46. The tool is then released and the lid is thereby locked shut against its spring force tending to open it, the dovetail and flanges thereby constituting locking means for the lid. If the strips 12, 14 are subsequently pulled outwardly from the terminating means 30, 32 the barbs 48, 50 bite into the material of the strips and securely holds them in place. The barbs thus constitute securing means for the strips.

It should be born in mind that various synthetic materials are now available from which the terminating means 30, 32 could be constructed. For instance they could be moulded from certain plastics. In this case the securing means is likely to comprise projections from the lid 42 or from the floor 40.

Whatever material is chosen the locking means of the lid may not be as illustrated but could comprise a tapering of the dimension A and a constant width of the lid 42. Tabs could be provided or any convenient alternative to that shown.

In any event the result is an aesthetically adequate means of terminating a zip without the attendant difficulties of fixing it to the zip.

What is claimed is:

1. End terminating means for a zip fastener comprising two strips of material adapted to be releasably secured together, said end terminating means comprising:

a receptacle having an open end through which adjacent ends of the strips are insertable, said receptacle comprising a box-like structure of substantially rigid material having said open end and a closed end remote from said open end, two opposing closed sides, a base and an opening above said base, and a lid pivoted at said remote end; and locking means to lock said lid to said box-like structure to close said opening; and securing means to retain said ends in said receptacle when said lid is closed.

2. End terminating means according to claim 1 wherein said lid has slightly larger dimensions than said opening and wherein said locking means comprises:

said lid engaging inside said opening so that interference between said opening and lid prevents the lid from pivoting open.

3. End terminating means according to claim 2 wherein said lid is dove-tailed from its pivot.

4. End terminating means according to claim 1 wherein said securing means comprises:

barb means on the lid adapted to engage the strips when said adjacent ends thereof are inserted in said open end of said box-like structure and when said lid is closed.

5. End terminating means according claim 1 wherein said receptacle is shaped from metal punched from a sheet thereof.

6. End terminating means according to claim 4 wherein said receptacle is shaped from metal punched from a sheet thereof and wherein said barb means comprises projections on the edge of the lid which is remote from the pivot thereof, which projections are oriented towards said base.

7. A zip fastener incorporating end terminating means according to claim 1.

8. A zip fastener according to claim 7 wherein the strips of material have teeth means provided along adjacent edges thereof, which teeth means are adapted to be engaged together to releasably interlock with one another, by sliding clasp means mounted on each edge of the strips, said end terminating means preventing said clasp means from being drawn off said ends of the strips.

* * * * *